US008939443B2

(12) United States Patent
Wyble et al.

(10) Patent No.: US 8,939,443 B2
(45) Date of Patent: Jan. 27, 2015

(54) IMAGING APPARATUS AND METHODS FOR BINDERY SYSTEMS

(71) Applicant: R. R. Donnelley & Sons Company, Chicago, IL (US)

(72) Inventors: Ty Daniel Wyble, New Providence, PA (US); Todd Tracy Rose, York, PA (US)

(73) Assignee: R.R. Donnelley & Sons Company, Chicago, IL (US)

( * ) Notice: Subject to any disclaimer, the term of this patent is extended or adjusted under 35 U.S.C. 154(b) by 29 days.

(21) Appl. No.: 13/837,152

(22) Filed: Mar. 15, 2013

(65) Prior Publication Data

US 2014/0272142 A1 Sep. 18, 2014

(51) Int. Cl.
*B65H 29/24* (2006.01)
*B41M 3/00* (2006.01)

(52) U.S. Cl.
CPC ..... *B41M 3/00* (2013.01)
USPC ..... 270/52.24; 271/195; 271/197

(58) Field of Classification Search
CPC .. B65H 29/242; B65H 29/32; B65H 2406/30; B65H 2406/3124; B65H 5/30; B65H 5/224
USPC ..... 270/52.24, 52.23; 271/195, 197
See application file for complete search history.

(56) References Cited

U.S. PATENT DOCUMENTS

| | | | | |
|---|---|---|---|---|
| 4,674,733 | A * | 6/1987 | Pessina et al. | 271/3.07 |
| 5,360,316 | A * | 11/1994 | O'Mara et al. | 414/798.9 |
| 6,254,092 | B1 * | 7/2001 | Yraceburu et al. | 271/276 |
| 6,582,072 | B1 * | 6/2003 | Wotton et al. | 347/104 |
| 6,745,685 | B2 * | 6/2004 | Kinoshita et al. | 101/118 |
| 7,293,770 | B2 * | 11/2007 | Edinger | 271/276 |
| 7,958,988 | B2 * | 6/2011 | Miyamoto | 198/689.1 |
| 2011/0293346 | A1 * | 12/2011 | Sato | 400/578 |

* cited by examiner

*Primary Examiner* — Leslie A Nicholson, III
(74) *Attorney, Agent, or Firm* — Hanley, Flight & Zimmerman, LLC

(57) ABSTRACT

Imaging apparatus and methods for bindery systems. An example apparatus disclosed herein includes a platform having a plurality of openings to provide suction through a surface of the platform and a first track that moves across the surface of the platform. The first track has a plurality of apertures to fluidly couple the suction to an upper surface of the first track.

20 Claims, 10 Drawing Sheets

IMAGING APPARATUS AND METHODS FOR BINDERY SYSTEMS

FIELD OF THE DISCLOSURE

This disclosure relates generally to bindery systems and, more particularly, to imaging apparatus and methods for bindery systems.

BACKGROUND

Postal services apply postal rate discounts to individuals and/or companies that presort mail to a particular presort level. The presort levels may be associated with mail being bundled together having the same carrier route number, the same five digit postal code mailing address, the same first three digits of the postal code mailing address or the same state or provincial mailing address. Each presort level may have a different postage rate. For example, the cost of postage may decrease depending on the number of pieces of mail presorted and/or the presort level achieved. Additionally, a plurality of different publications can be bundled together to increase the number of publications that qualify for a lower cost postage presort rate. To determine the number of mail presorted qualifies for the lower postage presort rate, the postal service employs equipment (e.g., automation equipment) configured to read indicia or other information (e.g., a bar code) provided on the mail.

However, when the postal service equipment cannot read the information or indicia provided on the mail, that particular piece of mail is rejected and is not counted toward the qualifying number of presort mail. Typically, the information or indicia is not readable by the presort equipment due to a low quality print and/or a distorted orientation of the printed information or indicia. As a result, the rejected bundled mail may not qualify for the bundled discount postage.

Figure 1:
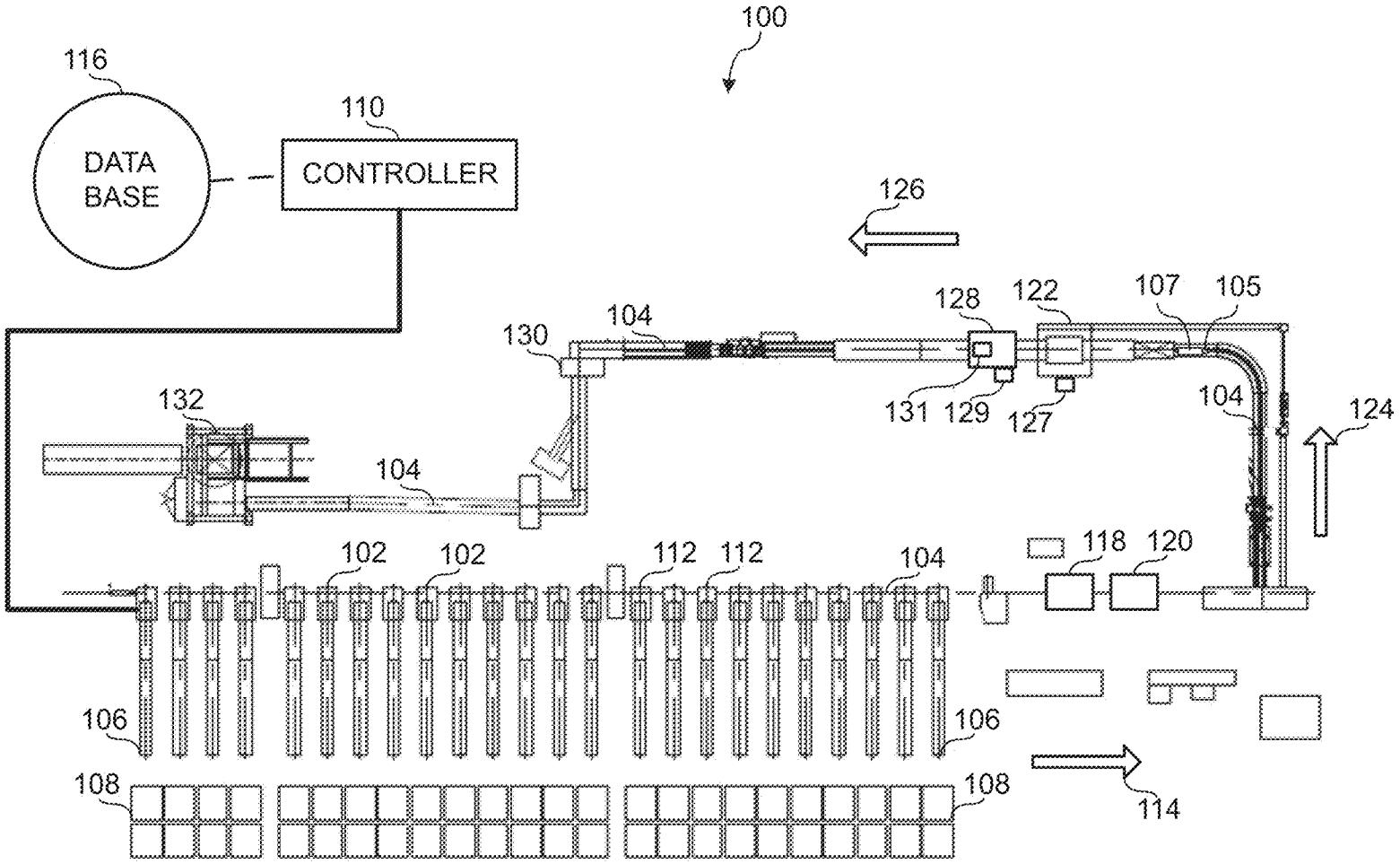
FIG. 1 is a schematic illustration of an example binding system having an example imaging apparatus constructed in accordance with the teachings disclosed herein.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above or below the other part with one or more intermediate part(s) located therebetween. Stating that any part is in contact with another part means that there is no intermediate part between the two parts.

DETAILED DESCRIPTION

Binding systems often employ an imaging apparatus (e.g., a printer, a labeler, etc.) to address books or magazines with the intended recipient's name, mailing address, a machine readable bar code and/or other information or indicia. More specifically, an imaging apparatus or addresser attempts to hold a page or a cover of a book substantially flat when processing the recipient's information onto the page or the cover to properly orient and/or prevent distortion of the information or indicia provided on a page or cover of the book or magazine. To hold down a page or cover during printing, known imaging apparatus typically employ mechanical guides or rails.

However, mechanical guides or rails can cause the page or cover to cant or become misaligned with the imaging apparatus, thereby resulting in a defective and/or improper orientation of the printing and/or labeling process. Additionally or alternatively, in some examples, the mechanical guides or rails overlap a printing or labeling area of the page or cover, thereby limiting the location or printing area onto which the imaging apparatus may apply the information or indicia (e.g., the bar code, the recipient's information, etc.). For example, the mechanical guides or rails typically extend past an edge of the page or cover and may overlap an existing image or indicia of the page or cover of the book. As a result, the imaging apparatus may overlap the information or indicia on an existing image provided on the page or cover due to the space constraints (e.g., the narrowing of the printing area due to the mechanical guides or rails).

Further, in some examples, the mechanical guides or rails have a thickness that may require a printer (e.g., a printer head) of the imaging apparatus to be spaced apart from the page or cover by at least a distance greater than the thickness of the mechanical guides or rails so that the mechanical guides rails do not interfere with the printer. In other words, a print head of the printer is often positioned at a throw distance (i.e., a distance between the page and the print head which ink must travel) that is at least greater than a thickness of the mechanical guides or rails projecting from the printing area of the page or the cover toward the printer. As a result, increasing a throw distance (e.g., a distance that ink must travel) may result in a poor quality print resolution (e.g., a smudged print).

Providing a poor quality print resolution may compromise the postal discounts associated with bundled presorted mail. For example, the cost of postage may decrease depending on the number of pieces of mail presorted and/or bundled together to increase the number of publications that qualify for a lower cost postage presort rate. Providing a poor quality image or print resolution may, for example, prevent a bar code reader at the post office from reading the bar code or indicia and qualifying the mail as presorted and/or bundled, thereby impacting the total number of mail pieces needed to qualify for the discount postage rate.

To provide higher quality readable indicia (e.g., addresses and/or bar codes), the example imaging apparatus disclosed herein significantly reduces a print distance (e.g., a throw distance or a distance in which ink must travel) between a printer apparatus and a printing area of a substrate (e.g., a cover or a page of a signature assembly) compared to known imaging apparatus. More specifically, the example imaging apparatus disclosed herein do not employ mechanical guides or rails to hold a position of the substrate. In particular, the print distance, for example, may be a minimum recommended distance that results is the highest achievable quality print resolution.

To reduce a print distance between a printing apparatus of the imaging apparatus and a substrate, the example imaging apparatus disclosed herein employ a vacuum or suction force to hold or maintain a position of the substrate as the printing apparatus prints the indicia on the printing area of the substrate. Thus, the example imaging apparatus disclosed herein do not employ mechanical guides or rails to hold the page or cover during printing as used by known imaging apparatus. As a result, a print distance between the printing apparatus and the substrate is not affected by mechanical guides or rails. Further, by eliminating the mechanical guides or rails and employing a vacuum or suction force to hold down the substrate, the printing area is expanded to the outermost edges (e.g., peripheral edges) of the substrate. Thus, the example imaging apparatus enables a larger printing area compared to known imaging apparatus that employ mechanical guides. As a result, the indicia in the printing area may be positioned away from other images on the substrate (e.g., positioned on the substrate such that the printed indicia does not overlap other previously printed indicia or images on the substrate or cover).

FIG. 1 depicts an example binding system 100 that can be used to implement the examples disclosed herein. The binding system 100 includes signature feeders 102 positioned near or at a conveyor 104. The binding system 100 may include any number of signature feeders 102 positioned in any suitable position relative to the conveyor 104. In some examples, the signature feeders 102 are coupled to respective hoppers 106 that may hold at least one signature (e.g., a page or a cover of a book) to be fed to the signature feeders 102. One or more of the hoppers 106 may be coupled to at least one additional hopper 108 positioned substantially perpendicular to, parallel to, behind or otherwise proximate at least one of the hoppers 106. The hopper 108 may increase the amount of signatures (e.g., signature capacity) that each of the hoppers 106 may hold. If an additional hopper 108 is coupled to at least one of the hoppers 106 (e.g., two additional hoppers 108 are coupled to the hopper 106), each of the signature feeders 102 is able to feed a plurality of different signatures onto the conveyor 104 when, for example, the first additional hopper 108 has signatures associated with a first book and the second additional hopper 108 has signatures associated with a second book. The signatures are deposited on and hang (e.g., in an inverted V-shape position) over a moving chain of the conveyor 104 as the book is assembled. The conveyor 104 of the illustrated example employs a pin 105 to move a signature assembly or a book 107 (e.g., a plurality of signatures stacked together) along the conveyor 104.

The binding system 100 includes a controller 110 (e.g., a main controller) that is communicatively coupled to the signature feeders 102 and/or any other device within the binding system 100. The controller 110 may determine the order (e.g., a first order, a second order, etc.) to deliver signatures to pockets and/or stations along the conveyor 104. The orders are based, at least in part, on recipient data (e.g., recipient addresses) of the recipients of the respective books, which may be stored in a database 116. In operation, a plurality of different recipient lists may be combined to generate a combined list (e.g., a single combined list) to optimize reductions in postal costs. Books on the list may be produced sequentially, alternating, etc.

For example, during a production run, there may be a number of codes assigned to each of the various book makeups (e.g., having different signature numbers, signature selections, etc.). The database 116 may store a record of each book to be processed and, within each record, a code may be stored indicating the makeup of and/or the signatures of a given book. The code, which is associated with a given book makeup, enables the controller 110 to select which signatures should be chosen to create a particular book. Thus, the controller 110 may control the respective signature feeders 102. Alternatively, the record in the database 116 may list the individual signatures to be fed to create a particular book as opposed to linking a code to a selection or a plurality of signatures.

Near the signature feeders 102, the conveyor 104 moves pockets 112 in a direction generally indicated by arrow 114. As the pockets 112 move in proximity to the front of the signature feeders 102, the respective signature feeders 102 may deliver a signature onto one or more of the pockets 112. As the pockets 112 move in front of the different signature feeders 102, the signatures may be stacked on top of one another, the last of which may correspond to a front and/or rear cover of a book.

In operation, some of the pockets 112 may be associated with a first book having a first thickness and/or trim size and some of the pockets 112 may be associated with a second book having a second thickness and/or trim size. Signatures that correspond to the first book may be delivered to a first pocket 112 and signatures that correspond to a second book may be delivered to a second pocket 112. In some examples, at least one of the signature feeders 102 is used to insert cards and/or inserts into both the first and second books. The first and second books may be different sizes, thicknesses and/or trims. Any particular book at one of the pockets 112 may have the same or different content than another book at another one of the pockets 112, even if the books have the same title.

To bind the signatures to produce a book, the binding system 100 includes a stitcher 118 that stiches the signatures together. In this example, the stitcher 118 is positioned between the signature feeders 102 and a rejecter 120. However, the stitcher 118 may be positioned elsewhere along the binding system 100. The stitcher 118 may create a saddle stitch or any other type of stitch to hold the signature pages together. Alternatively, pages may be glued together along a backbone of the book and then a cover may be positioned adjacent the backbone to produce a square back book.

The rejecter 120 may identify if a book meets predetermined criteria and/or if a book is defective. In some examples, a book may be defective for having the wrong number of signatures (e.g., too many or too few), misaligned signatures and/or one or more wrong signatures. If a book is defective, a replacement book may be reordered via the controller 110 at any time so that a replacement book is grouped with other books to receive a lower cost postage presort level. The reordered replacement book may be included in a bundle (e.g., a package) of other books with the same carrier route number, the same five digit postal code mailing address, the same first three digits of the postal code mailing address or the same state or provincial mailing address.

If a book is reordered, the controller 110 may change a first order (e.g., a first predetermined order) to a second or different order (e.g., a second predetermined order) to accommodate re-producing the defective book. The first and second orders may be different, the same or similar. In some examples, the controller 110 may cause the signature feeders 102 to leave one of the pockets 112 empty to ensure that the second order is achieved.

After the books have been stitched and checked, the conveyor 104 (e.g., a single mail stream) moves the pockets 112 toward a trimmer 122 in a direction generally indicated by arrows 124 and 126. All of the pockets 112 may have a book on them or some may be left empty (e.g., no book on them).

The trimmer 122 includes a plurality of cutters (e.g., blades, edges) that are adjusted to cut at least one of the edges of the different books so that all of the pages of the respective books have substantially the same dimensions and/or are flush with one another. The trimmer 122 may include a first station to cut a face of a book and a second station to cut a head and a foot of the book. However, the trimmer 122 may include any number of stations (e.g., 1, 2, 3, 4, etc.) to cut the different edges of the book.

The trimmer 122 may include a sensor 127 (e.g., an eye detector) to distinguish between the different book sizes. While the sensor 127 is depicted as adjacent the trimmer 122, the sensor 127 may be positioned in any position on the binding system 100. Additionally or alternatively, the controller 110 may associate and/or identify the different size books along the conveyor 104 and transmit this information to the trimmer 122.

The example binding system 100 also includes an example imaging apparatus 128 constructed in accordance with the teachings disclosed herein. The imaging apparatus 128 may include an imager (e.g., a printer), a print head, a labeler and/or any other suitable device for providing indicia to, for example, the book 107. For example, the imaging apparatus 128 customizes and/or personalizes the plurality of different books by addressing the books with the intended recipient's name, address and/or an associated bar code. As described in greater detail below, the imaging apparatus 128 of the illustrated example employs vacuum or suction, for example via a source 131, to hold or fix a position of the book 107 relative to, for example, a printer of the imaging apparatus 128 when providing an image to the book 107.

The imaging apparatus 128 may be positioned at any point in the binding system 100 (e.g., between signature feeders 102). In an example in which the imaging apparatus 128 is positioned between signature feeders 102, based on the number of number of signatures fed prior to the position of the imaging apparatus 128, the print head may be adjusted according to a height of a partially formed book to be addressed.

In some examples, the imaging apparatus 128 may include a sensor 129 to distinguish between the different books, sizes and/or thicknesses. Additionally or alternatively, the controller 110 may associate and/or identify the different size books along the conveyor 104 and transmit this information to the imaging apparatus 128. The imaging apparatus 128 may address an insert (not shown) that is to be inserted into the respective book. The imaging apparatus 128 and/or the sensor 129 may be located at another location on the binding system 100. The binding system 100 may have any number of imaging apparatus 128 (e.g., 1, 2, 3, etc.) to personalize the different books.

After the books are trimmed and addressed, the conveyor 104 leads to a stacker (e.g., a backend stacker) 130 that sorts and/or packages the books. The order in which the stacker 130 places and/or intermingles the different books may be an order that is the same as the first order, the second order or another order that attempts to optimize postal discounts. The stacker 130 groups the different books into packages (e.g., bundles) that have the same mailing presort level. The binding system 100 may have any number of stackers (e.g., 1, 2, 3, etc.). While the above examples describe sorting first and second books, the example binding system 100 may produce any number of different books (e.g., a first book, a second book, a third book, etc.) at the same time. In this example, after the different books are packaged, the packages move along the conveyor 104 to a palletizer 132 that places the different packages onto pallets for shipment.

In some examples, the imaging apparatus 128 may be used in connection with co-mailing lines and/or hybrid lines. In a hybrid line, books being assembled on a signature-by-signature basis are co-mailed with preassembled books. In a co-mailing line, sets of pre-assembled books may be produced without being addressed on separate binding lines and then brought together into a merging operation to maximize postal discounts using two or more titles in a run.

Figure 2:
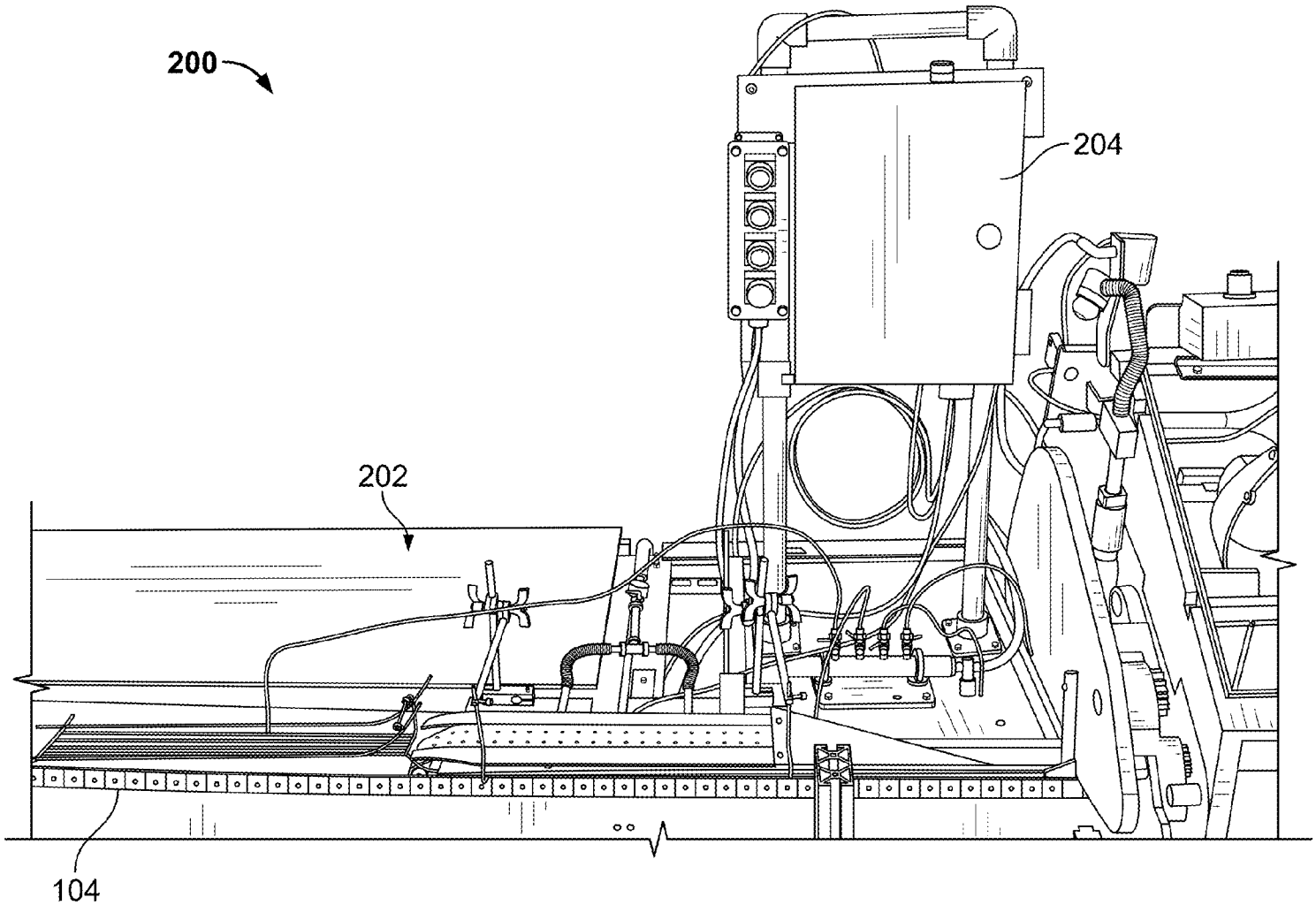
FIG. 2 is an example imaging apparatus constructed in accordance with the teachings disclosed herein that may be used to implement the example binding system of FIG. 1. The example imaging apparatus is shown without a printing apparatus for clarity.

FIG. 2 illustrates an example imaging apparatus 200 constructed in accordance with teachings disclosed herein that may be used to implement the binding system 100 of FIG. 1. Referring to FIG. 2, the example imaging apparatus 200 includes a transport system 202 positioned adjacent the conveyor 104. A controller 204 is communicatively coupled to and/or operates the transport system 202 of the imaging apparatus 200. The controller 204 may be communicatively coupled to the main controller 110 of FIG. 1 and/or may control imaging apparatus 200 independently of the binding system 100 and/or the main controller 110. In some examples, the imaging apparatus 200 may be a standalone system. In such some examples, a feeder or hopper provides or directs (e.g., feeds) a signature assembly or book (e.g., the book 107) to the imaging apparatus 200.

Figure 3:
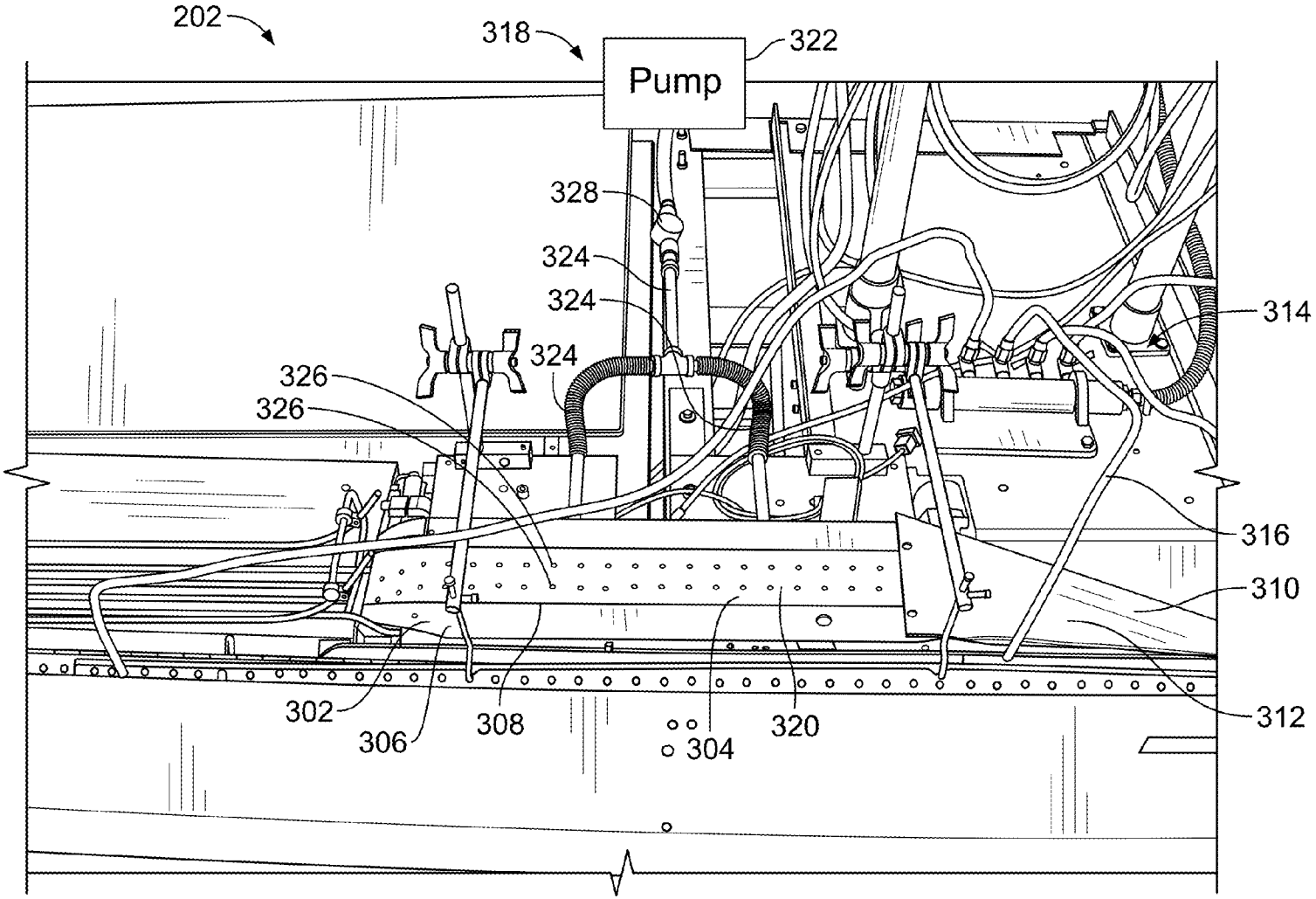
FIG. 3 is an enlarged partial view of the example imaging apparatus of FIG. 2.

FIG. 3 is an enlarged view of the example transport system 202 of FIG. 2. As shown in FIG. 3, the transport system 202 includes a platform 302 configured to receive a track 304. The platform 302 of the illustrated example positions the track 304 adjacent or in an offset relationship relative to the conveyor 104 (e.g., the pin 105 of the conveyor 104). In particular, the platform 302 of the illustrated example defines a surface 306 (e.g., an upper surface) having a groove or channel 308 to receive the track 304. The track 304 of the illustrated example is a belt that moves or slides across the surface 306 of the platform 302 (e.g., within the groove 308). A separator 310 is positioned adjacent the track 304 (e.g., at an entrance of the track 304) to separate at least a first page from the signature assembly or the book 107 and guides the first page on the track 304. The separator of the illustrated example is composed of copper. However, in other examples, the separator 310 may be composed of aluminum and/or any other material(s).

To ensure that the first page is held against an upper surface 312 of the separator 310, the example imaging apparatus 200 of the illustrated example includes a pressure system 314. For example, the pressure system 314 applies compressed air (e.g., at a pressure greater than atmospheric pressure) at a specified or regulated air pressure in a direction toward the surface 312 of the separator 310 (e.g., a substantially vertical force provided by the air pressure) to help hold down the first page on the separator 310 as the first page moves along the upper surface 312 of the separator 310. Additionally or alternatively, the pressure system 314 applies compressed air in a direction toward a side surface or wall 312*a* of the separator 310 to help maintain other pages of the book 107 against the side surface or wall 312*a* when the first page is positioned on the separator 310. The pressurized air can be provided by a pump and fluidly coupled to the separator via tubing 316 (e.g., copper piping).

Additionally, the example imaging apparatus 200 employs a vacuum or suction system 318 to provide a vacuum or suction (e.g., a pressure less than atmospheric pressure) to hold the first page of the book 107 against an upper surface 320 of the track 304 as the track 304 moves the first page of the book 107 across the platform 302 and to a printing apparatus described in greater detail below. To provide or generate a vacuum or suction, the example suction system 318 employs a pump 322. The pump 322, for example, creates a pressure (e.g., a positive or negative pressure) at the surface 306 of the platform 302 that is less than atmospheric pressure just above or outside of the perimeter or envelope of the platform 302. In this manner, air outside of or adjacent the platform 302 having a higher pressure (e.g., atmospheric pressure) flows toward the surface 306 of the platform 302 having the lower pressure (e.g., a negative pressure).

The pump 322 of the illustrated example is operatively or fluidly coupled to the platform 302 via a flow path 324 (e.g., tubing). As noted above, the suction is provided to and/or through a portion of the surface 306 defined by the groove 308 (e.g., within a perimeter of the groove 308. In turn, the suction or vacuum is applied to the first page of the book 107 via a plurality of apertures 326 formed through the track 304. In this manner, the vacuum or suction is applied to a surface or face of the first page of the book 107 to hold the first page against the upper surface 320 of the track 304 as the track moves relative to the surface 306 of the platform 302.

In the illustrated example, the example suction system 318 employs a regulator 328 to regulate a pressure of the suction or vacuum provided by the pump 322. In this manner, the regulator 328 controls an amount of force provided to the first page of the book 107 to prevent the first page from crimping, becoming distorted, ripped wrinkled, and/or otherwise damaged as the first page travel across the platform 302 via the track 304. The regulator 328 of the illustrated is a manually adjustable pressure regulator. However, in other examples, the adjustability of the regulator 328 may be automated via a pilot regulator and/or other pressure loaded regulator (e.g., pneumatic dome-loaded regulator, a loading regulator, etc.).

Figure 4A:
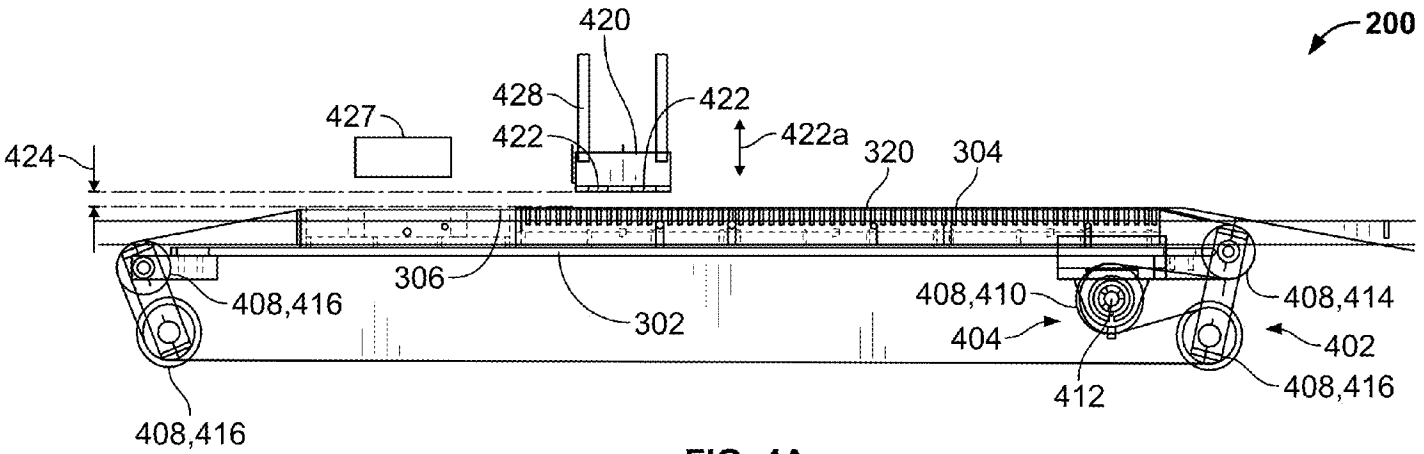
FIG. 4A is a side view of an example platform and track of the example imaging apparatus of FIGS. 2 and 3 shown with an example printing apparatus and a drying apparatus of the example imaging apparatus disclosed herein.
Figure 4B:
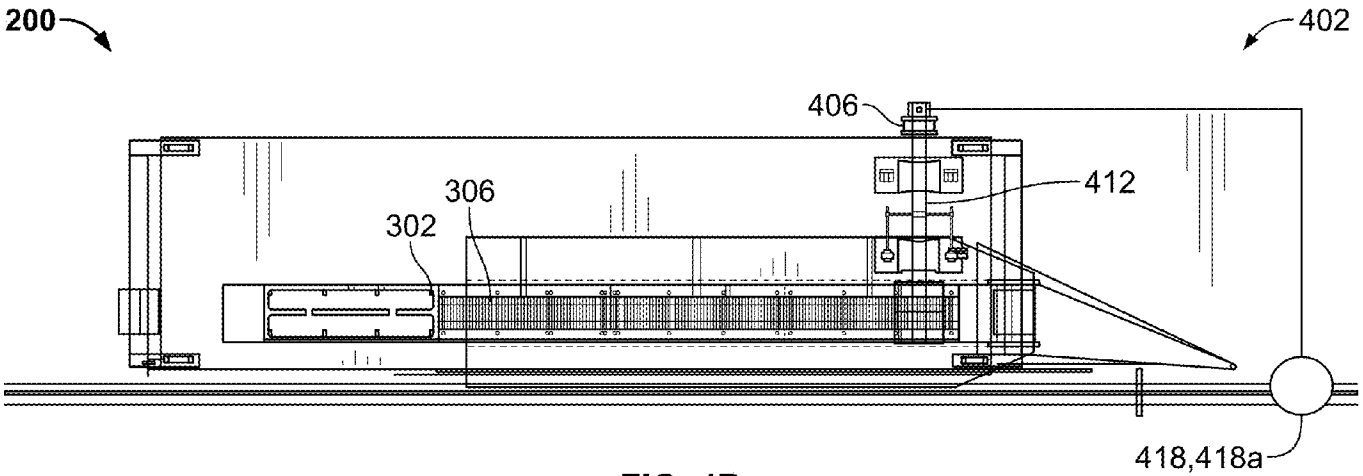
FIG. 4B is a plan view of the example platform and track of FIG. 4A.

FIG. 4A is a side view of the example platform 302 and the track 304 of FIGS. 1-3. FIG. 4B is a plan view of the example platform 302 and the track 304 of FIG. 4A. Referring to FIGS. 4A and 4B, the example track 304 is movably coupled to the platform 302 via a drive assembly 402. In particular, the drive assembly 402 (e.g., a servo drive system) moves (e.g., slides) the track 304 over, across or along the surface 306 of the platform 302. The drive assembly 402 of the illustrated example includes a transmission system or assembly 404 driven by a drive or motor 406 (e.g., a servo motor). The transmission system 404 of the illustrated example includes a plurality of pulleys or wheels 408 that includes a drive wheel or pulley 410 coupled to an output shaft 412 of the motor 406 and a driven wheel or pulley 414 coupled to the drive pulley 410 via the track 304. The track 304 of the illustrated example is a belt (e.g., a rubber belt) that wraps around the pulleys 408. The transmission system 404 of the illustrated example also includes a plurality of idler pulleys or wheels 416 to support the track 304 (e.g., the belt). In other examples, the motor 406 can be configured to drive the track 304 via, for example, chain and/or gear drive configurations, clutches, and/or other transmission configurations. In yet other example implementations, each of the pulleys or wheels 408 can be driven by a separate, respective motor via, for example, a shaft, an arbor, a spindle, etc., or any other drive(s).

The example drive system 402 of the illustrated example includes a speed sensor 418 to monitor the output speed of the motor 406 and/or the track 304. The speed sensor 418 of the illustrated example is an encoder 418*a* is coupled (e.g., directly coupled and/or operatively coupled) to the output shaft 412. The encoder 418*a* may be implemented using, for example, an optical encoder, a magnetic encoder, etc. In yet other example implementations, other speed measurement devices may be used instead of the encoder 418*a* to monitor the speeds of the motor 406 and/or the track 304.

As shown in FIG. 4A, the track 304 of the illustrated example moves a page or cover of the book 107 toward a printing apparatus 420 (FIG. 4A). The printing apparatus 420 may include one or more print heads 422 (e.g., ink jet printer heads) for printing indicia (e.g., the recipient's information or other indicia) on the page or cover of the book 107. A distance 424 (e.g., a throw distance) of the printing apparatus 420 can be adjusted in a direction 424*a* (e.g., a vertical direction). As a result, the printing apparatus 420 can be adjusted to any desired distance 424 relative to a page of the book 107 positioned on the upper surface 320 of the track 304 and/or the surface 306 of the platform 302. Because the platform 302 employs a suction force to hold the page or cover against the upper surface 320 of the track 304, neither the track 304 nor the platform 302 interferes with the height position or distance 424 (e.g., a throw distance) of the printing apparatus 420 relative to the page positioned on the upper surface 320 of the track 304 and/or the surface 306 of the platform 302. As a result, the print heads 422 may be positioned at any desired position or distance 424 from the page of the book 107 and/or the upper surface 320 of the track 304. For example, the distance 424 may be between approximately 3 and 5 millimeters. In some examples, the distance 424 can be less than 3 millimeters or near zero millimeters (e.g., less than 1 millimeter) from the page of the book 107. Providing a smaller or minimum distance 424 reduces the travel path of ink (e.g., UV ink) or other imaging liquids, thereby increasing and/or improving the printing resolution and/or quality of the printing apparatus 420. A dryer 427 (e.g., a UV dryer) may be positioned adjacent the printing apparatus 420 to help dry the ink deposited on the book 107.

The distance 424 may be adjusted based on the characteristics (e.g., a thickness) of a first page, a cover and/or the book 107. For example, the distance 424 of the print heads 422 may be adjusted manually and/or automatically during printing. For example, the printing apparatus 420 of the illustrated example is coupled to a print adjustment mechanism 428 that mechanically adjusts the distance 424 of the print heads 422 relative to the first page of the book 107 based on the thickness of the page or cover of the book 107. For example, the controller 204 may be configured to adjust the position of the print adjustment mechanism 428 based on the characteristics of the book 107. The printer adjustment mechanism 428 may be, for example, one or more rails slidably or movably coupled to a track and movable relative thereto via a motor (e.g., a stepper motor).

Figure 5A:
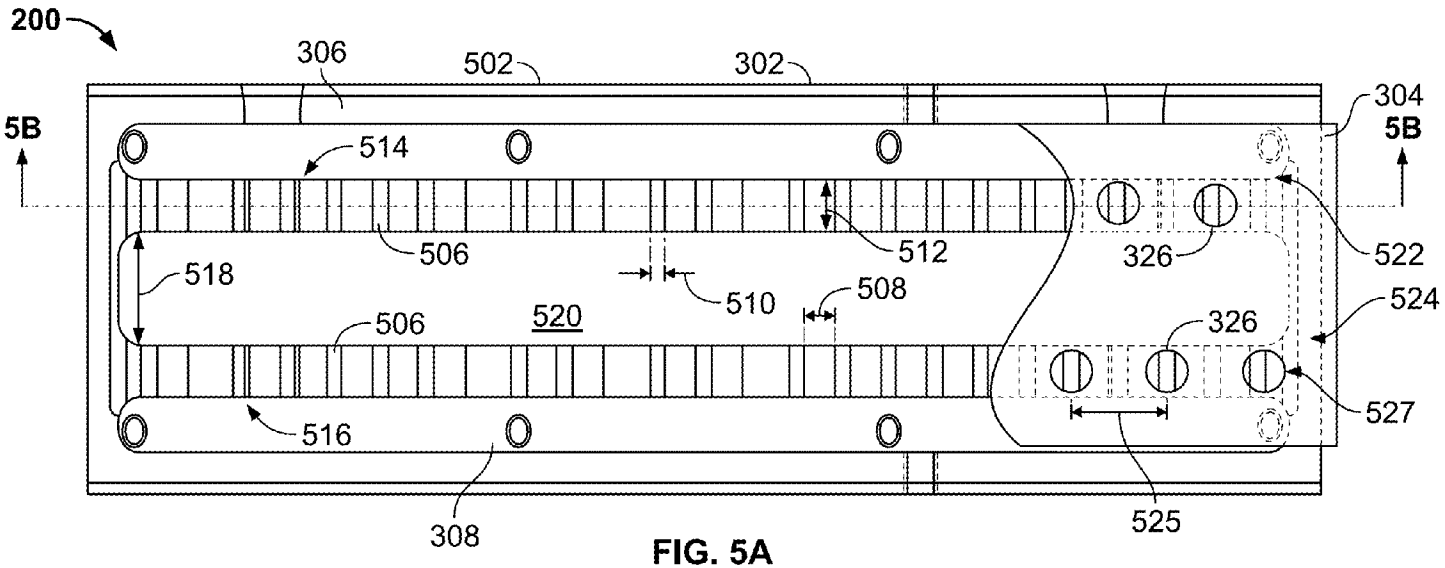
FIG. 5A is a plan view of the example platform of FIGS. 4A and 4B shown with a partial portion of the example track coupled thereto.
Figure 5B:
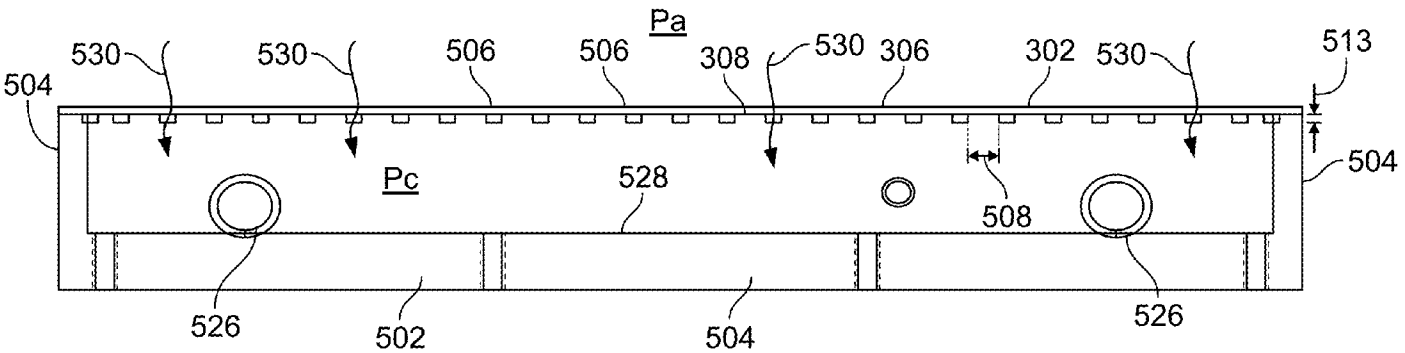
FIG. 5B is a cross-sectional view of the example platform of FIG. 5A taken along line 5B-5B.

FIG. 5A is a plan view of the example platform 302 of FIGS. 2, 3, 4A and 4B showing a partial portion of the track 304 coupled thereto. FIG. 5B is a side view of the example platform 304 of FIG. 5A. Referring to FIGS. 5A and 5B, the example platform 302 comprises a housing or block 502 defining the surface 306 and side walls 504 to define a rectangular shaped profile or dimensional envelope. The block 502 may be composed of aluminum, steel, an alloy, and/or any other material(s). The block 502 defines a plurality of openings or channels 506 formed through the surface 306 of the block 502. Each of the openings 506 is spaced apart by a distance 508 (e.g., a distance of between approximately ¼ inch and 1 inch). Additionally, the openings 506 of the illustrated example have a rectangular shape or profile such that the openings 506 of the illustrated example are defined by a width 510 (e.g., approximately ⅛ of an inch) and a height 512 (e.g., approximately 5/16 of an inch). The example width 510 may be any width and the height 512 may be any length. Further, the openings 506 of the illustrated example have a depth 513 (e.g., a depth of between approximately 1/16 of an inch and ¼ of an inch). Additionally or alternatively, in other examples, one or more of the openings 506 may have an arcuate shape or profile, a triangular shape or profile and/or any other shape(s) or profile(s).

Further, the openings 506 of the illustrated example are arranged or configured in a first row 514 and a second row 516, the first row 514 being spaced apart from the second row 516 by a distance 518. In other examples, the openings 506 may be provided in any other suitable arrangement (e.g., zigzag, serpentine, etc.).

The openings 506 of the illustrated example are positioned on a surface 520 defined by the groove 308 (e.g., a perimeter of the groove 308) of the platform 302. In particular, the surface 520 of the illustrated example is recessed relative to the surface 306 of the platform 302. In this manner, the track 304 traverses, slides, moves and/or otherwise moves over the openings 506 positioned in the groove 308 and/or the upper surface 320 of the track 302 is substantially flush relative to the surface 306 of the platform 302. As a result, the apertures 326 formed in the track 304 fluidly communicate with the openings 506 of the platform 302. More specifically, the apertures 326 of the track 304 are arranged in a first row 522 and a second row 524. In particular, when the track 304 is coupled to the platform 302, the first row 522 of apertures 326 substantially align with the first row 514 of openings 506 and the second row 524 of apertures 326 substantially align with the second row 516 of openings 506. In this manner, the apertures 326 of the first row 522 fluidly communicate with the openings 506 of the first row 514 and the apertures 326 of the second row 524 fluidly communicate with the openings 506 of the second row 524. The example apertures 326 of the illustrated example have an arcuate or circular shape or profile. In other examples, the apertures 326 may have an elliptical shape or profile, a rectangular shape or profile, a triangular shape or profile, and/or any other suitable shape or profile. Additionally, each of the apertures 326 in the first and second rows 522, 524 are spaced apart by a distance 525 (e.g., between approximately ⅛" to 1") and have a diameter 527 (e.g., a diameter approximately ¼").

In other examples, the example platform 302 and/or the example track 304 may include a single row (e.g., rows 514, 522) of the apertures 326 or openings 506. For example, the single row may be centrally aligned relative to the groove 308. In other examples, the platform 302 and/or the track 304 may employ more than two rows of the apertures 326 and/or the openings 506. In yet other examples, the apertures 326 in the first and second rows 522, 524 may be connected via a slot or other opening. Likewise, the openings 506 in the first and second rows 514, 516 may be connected via a slot or other opening.

The side wall 504 of the block 502 includes one or more fittings or couplings 526 (e.g., a NPT fitting) to fluidly couple the pump 322 (FIG. 3) to the block 502 via the tubing 324 (FIG. 3). The fittings 526 are in fluid communication with the openings 506 via a chamber 528 defined by the walls 504 and the surface 306 of the block 502. The chamber 528, in turn, is in fluid communication with the plurality of openings 506. Thus, the vacuum or suction provided by the pump 322 to the openings 506 is provided via the tubing 324, the openings 506 and the chamber 528 of the block 502. More specifically, the pump 322 causes a pressure Pc in the chamber 528 that is less than a pressure Pa surrounding the environment in which the imaging apparatus 200 is positioned. For example, the pressure Pc provided by the pump 322 in the chamber 528 is less than the atmospheric pressure Pa outside of the chamber 528. The pressure Pc provided by the pump can be a negative pressure or a pressure that is less than the pressure Pa (e.g., atmospheric pressure). As a result, air 530 (having the pressure Pa) is drawn into and/or flows into the chamber 528 via the apertures 326 and the openings 506 to provide a suction or vacuum force or effect on the first page of the book 107. The suction or vacuum provides a sucking force on the first page of the book 107 via the apertures 326 when the first page is positioned on the track 304.

Figure 6:
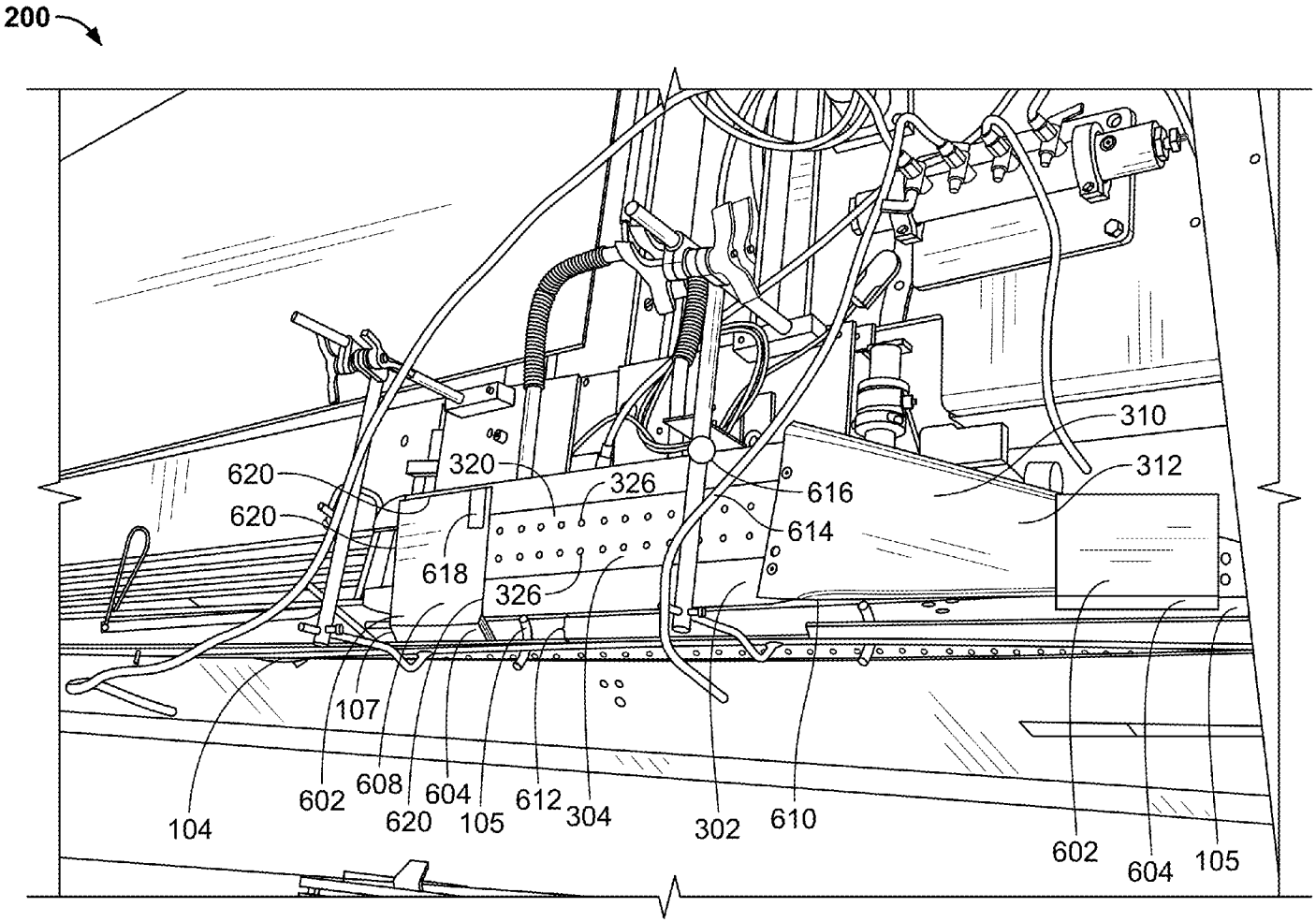
FIG. 6 is a perspective view of the example imaging apparatus of FIGS. 2, 3, 4A, 4B, 5A and 5B shown without the printing apparatus and the drying apparatus.

FIG. 6 is a perspective view of the imaging apparatus 200 of FIGS. 2, 3, 4A, 4B, 5A and 5B. In operation, the signature assembly or book 107 (e.g., a magazine, a book) is transported to the imaging apparatus 200 via the conveyor 104. In particular, the pin 105 of the conveyor 104 engages the book 107 and moves the book 107 toward the separator 310 of the imaging apparatus 200. The separator 310 engages at least a first page 602 of the book 107 and separates the first page 602 from at least a second page 604 of the book 107. As the pin 105 of the conveyor 104 moves the book 107 toward the separator 310, the first page 602 of the book 107 slides or travels on the upper surface or ramp 312 of the separator 310 to facilitate the separation of the first page 602 and the second page 604. The separator 310 also includes a tapered portion or side wall 606 to accommodate books or pages (e.g., the first page 602) having different sizes (e.g., lengths). Further, to help hold the first page 602 on the upper surface 312 of the separator 310, the imaging apparatus 200 of the illustrated example employs the pressure system 314. The pressure system 314 directs pressurized air (e.g., regulated pressurized air) toward a first surface or face 608 of the first page 602 to help maintain the first page 602 on the separator 310 as the conveyor 104 moves the book 107 via the pin 105 and toward the track 304. Further, the separator 310 directs or guides the second page 604 of the book 107 along a side wall 610 of the separator 310. More specifically, the second page 604 of the book 107 (and all other pages not positioned on the upper surface 312 of the separator 310) moves along a gap 612 between the side wall 610 of the separator 310 and the conveyor 104. The conveyor 104 continues to push the book 107 via the pin 105 until the first page 602 reaches the track 304 (e.g., the first page 602 is positioned on the track 304).

Additionally or alternatively, the example imaging apparatus 200 may include a sensor 616 (e.g., a photoelectric eye) to sense the presence of the book 107 approaching the track 304. The controller 204 determines a position of the book 107 in the sequential order based on one or more signals received from the sensor 616. The controller 204 then sends the information associated with the book 107 to the printing apparatus 420. Further, the controller 204 may be configured to initiate the track 304 and the pump 322 based on the one or more signals provided by the sensor 616 (e.g., of the approaching book 107).

When the track 304 receives the first page 602, the second page 604 continues to travel along the gap 612. The first page 602 travels on the first track 304 across the surface 306 of the platform 302 and to the printing apparatus 420 (FIG. 5A). The vacuum or suction is initiated via the pump 322 and draws the first page 602 of the book 107 against the upper surface 320 of the track 304. More specifically, the pressure or force provided by the vacuum or suction acts on the first page 602 of the book 107 via the openings 506 (FIG. 5A) in the surface 306 of the platform 302 and the apertures 326 of the track 304. The apertures 326 of the track 304 enable the air 530 outside of the chamber 528 to be sucked or drawn through the openings 506 of the platform 302 causing a force to be applied the first page 602 of the book 107 in a direction toward the surface 306 of the platform 302 (e.g., a downward force). As noted above, the transport system 202 employs the regulator 328 to maintain the force or suction pressure below a maximum desired pressure value. In this manner, the suction force provided by the pump 322 does not cause damage and/or distorts (e.g., crimp, wrinkle, etc.) the first page 602 as the first page 602 moves to the printing apparatus 420. Instead, the vacuum or suction force maintains the first page 602 substantially flat or flush on and/or relative to the upper surface 320 of the track 304.

The track 304 transports the first page 602 to the printing apparatus 420, which prints or provides indicia to a printing area 618 of the first page 602. Because the first page 602 is held against the track 304 via the vacuum, the printing area 618 of the first page 602 is defined by outer edges 620 of the first page 602 (e.g., edge to edge printing capability). Further, due to the suction provided at the surface 520, the printing apparatus 420 may be at any desired position or distance 424 from the surface 608 of the first page 602 to achieve the highest possible quality print (e.g., based on the throw distance 424). Based on the information received associated with the sequential order of the book 107 via, for example, the sensor 616, the data base 116, the main controller 110 and/or the controller 204, the printing apparatus 420 prints or provides the indicia on the printing area 618 as the track 304 moves the first page 602 across or over the platform 302.

Further, the controller 204 of the imaging apparatus 200 of the illustrated example drives the motor 426 and/or the track 304 at a speed that is greater than a percentage value of a speed of the conveyor 104. For example, the controller 204 may receive or detect a speed of the conveyor 104 via, for example, the controller 110, the encoder 418*a* or other speed sensor 418, and causes the motor 426 to drive the track 304 at a speed that is five percent greater than the speed of the conveyor 104. As a result, the book 107 is operatively decoupled or disengaged from the conveyor 104. More specifically, the book 107 is moved away or spaced apart from the pin 105 of the conveyor 104. In this manner, vibrational forces caused by the conveyor 104 (e.g., a chain of the conveyor 104) do not transfer to the first page 602 of the book 107 during printing. As a result, the printing apparatus 420 achieves a higher quality print. After the book 107 is released from the track 312, the lagging pin 105 reengages with the book 107 and transports the same downstream from the imaging apparatus 200 to, for example, the stacker 130 of FIG. 1.

Figure 7:
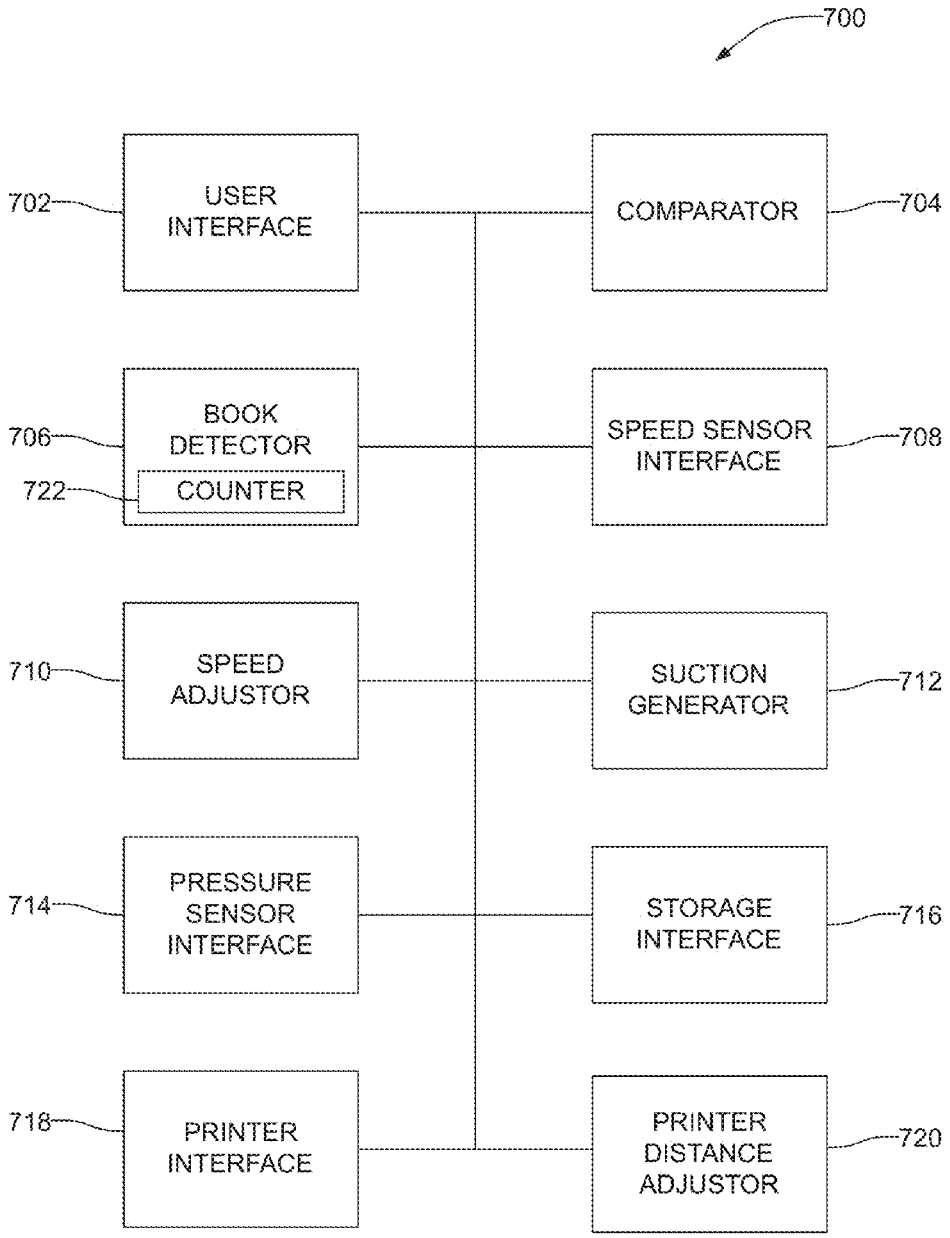
FIG. 7 illustrates an example apparatus or system that may be used to operate the example imaging apparatus of FIGS. 2, 3, 4A, 4B, 5A, 5B and 6.

FIG. 7 is a schematic illustration of an example system 700 that may be used to implement the example imaging apparatus 200 of FIGS. 2, 3, 4A, 4B, 5A, 5B and 6 (e.g., the transport system 202 and/or the controller 204). While an example manner of implementing the imaging apparatus 200 of FIG. 2 is illustrated in FIG. 7, one or more of the elements, processes and/or devices illustrated in FIG. 7 may be combined, divided, re-arranged, omitted, eliminated and/or implemented in any other way. Further, the example motor 406, the pump 322, the pressure system 314, the printing apparatus 420, the printer adjustor 428 and/or, more generally, the example imaging apparatus 200 of FIG. 2 may be implemented by hardware, software, firmware and/or any combination of hardware, software and/or firmware. Thus, for example, any of the example motor 406, the pump 322, the pressure system 314, the printing apparatus 420, the printer adjustor 428 and/or, more generally, the example imaging apparatus 200 could be implemented by one or more analog or digital circuit(s), logic circuits, programmable processor (s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example motor 406, the pump 322, the pressure system 314, the printing apparatus 420 and/or the printer adjustor 428 are hereby expressly defined to include a tangible computer readable storage device or storage disk such as a memory, a digital versatile disk (DVD), a compact disk (CD), a Blu-ray disk, etc. storing the software and/or firmware. Further still, the example imaging apparatus 200 of FIG. 2 may include one or more elements, processes and/or devices in addition to, or instead of, those illustrated in FIG. 7, and/or may include more than one of any or all of the illustrated elements, processes and devices.

As shown in FIG. 7, the example system 700 includes a user interface 702, a comparator 704, a book detector 706, a speed sensor interface 708, a speed adjustor 710, a suction generator or printer adjustor 712, a pressure sensor interface 714, a storage interface 716, a printer interface 718, and a printer adjustor 720, all of which may be communicatively coupled as shown or in any other suitable manner.

The user interface 702 may be configured to receive input information from an operator. For example, the user interface 702 may be implemented using a mechanical and/or graphical user interface via which an operator can manually input book characteristic(s), indicia information, a suction pressure, a speed of the track 302, a throw distance 424 of the printing apparatus 420 and/or other information by entering the information via the user interface 702. In some examples, the user interface 702 may be configured to retrieve the input information (e.g., book characteristics 107 and/or the indicia information) from a look-up table or data structure from the data base 116 of FIG. 1 or the storage interface 716 based on, for example, a title of the book and/or a code provided by the operator via the user interface 702. The user interface 702 may be configured to communicate the input information to the controller 110, controller 204, the speed adjustor 710, the printer interface 718, the printer adjustor 720 and/or the suction generator 712.

The book detector 706 may be configured to detect the presence of a book approaching the separator 310 and/or the track 304. For example, the book detector 706 is configured to receive a signal from a motion sensor such as, for example, the sensor 616 of FIG. 6. Further, the book detector 706 may be configured to detect if the book is positioned on the track 304. The book detector 706 may then communicate this information to the speed adjustor 710, the suction generator 712, the printer adjustor 720 and/or the controller 204.

Additionally or alternatively, the book detector 706 can detect or identify a book in a sequential order or list associated with a production run that is provided via the input interface 702, the data base 116 and/or storage interface 716. For example, to identify the book, the book detector 706 may employ a counter 722 to count each book detected (e.g., via the sensor 616) during a production run and assign a number each book that is detected. The book detector 706 may communicate the assigned number to the comparator 704. To identify the book approaching the imaging apparatus 200, the comparator 704 may compare (e.g., match) the assigned number provided by the counter 722 with a corresponding number pre-identified in the sequential order or list (e.g., a look-up table) of the production run which includes information corresponding to the identified book (e.g., book characteristics, recipient's information, etc.). The comparator 704 may obtain or retrieve the sequential list from, for example, the storage interface 716 and/or the data base 116. The book detector 706 may communicate the identified book to the printer adjustor 720, the suction generator 712 and/or the controller 204.

The speed sensor interface 708 is configured to detect or sense a speed of the track 304. For example, the speed sensor interface 708 may be communicatively coupled to a speed measurement device such as, for example, the speed sensor 418 or the encoder 418*a* of FIGS. 4A. The speed sensor interface 708 can be configured to obtain speed values of the motor 406 and/or the track 304 by, for example, reading measurement values from the encoder 418*a*. Additionally or alternatively, the speed sensor interface 708 may be configured to receive a speed of the conveyor 104 via, for example, the controller 110, a speed measurement device (e.g., a speed sensor), the data structure 116 and/or the storage interface 716. The speed sensor interface 708 may be configured to send the speed values to the comparator 704, which may be configured to compare the speed values of the motor 406 or the track 304 and the conveyor 104 obtained from the speed sensor interface 708 and communicate the comparison results of the comparisons to the speed adjustor 710.

The speed adjustor 710 may be configured to drive the motor 406 and/or the track 304 at a relatively faster speed than the speed of the conveyor 204 (e.g., a predetermined speed value). For example, the speed adjustor 710 can be configured to adjust the speed of the motor 406 and/or the track 304 based on the comparison results obtained from the comparator 702 until a speed ratio between the measured speed value of the motor 406 or the track 304 and the measured speed value of the conveyor 104 is substantially equal to the predetermined speed ratio value (e.g., a motor 406 or track 304 speed that is approximately 5% greater than the speed value of the conveyor 104).

The suction generator 712 may be configured to initiate the pump 322. For example, the suction generator 712 may be configured to initiate the pump 322 based on a book presence detected by the book detector 706. Additionally or alternatively, the suction generator 712 may be configured to initiate the pump 322 based on a command received via the input interface 702 and/or a command signal from the controller 204.

The pressure sensor interface 714 may be configured to detect or sense a pressure of the suction provided by the pump 322. For example, the pressure sensor interface 714 may receive a signal from the pressure regulator 328 which is indicative of the pressure associated with the suction force at the openings 506 of the platform 506 or a pressure within the chamber 528. The pressure sensor interface 714 may be configured to communicate the measured pressure value to the comparator 704. The comparator 704 and/or the pressure sensor interface 714 may be configured to compare the measured pressure value to a predetermined pressure value (e.g., a maximum allowable pressure value) associated with the characteristics of a particular book positioned on the track 304 identified by the book detector 706. For example, the comparator 704 may retrieve the book characteristics from the book detector 706, the user interface 702, the data structure 116 and/or the storage interface 716. The comparator 704 may communicate the comparison results to the suction generator 712.

The suction generator 712 may be configured to adjust the pressure provided by the suction to a desired range (e.g., below a maximum pressure). For example, the suction generator 712 may be configured to cause the pump 322 to provide greater pressure or less pressure if communicate the comparison results of the comparisons to the speed adjustor 710 until the pressure sensor interface 714 detects that the pressure is within an acceptable range associated with the characteristic(s) of the book obtained via the book detector 706, the input interface 702 and/or the storage interface 716.

The printer interface 718 may be configured to receive the indicia information for printing on the printing area 608 of the first page 602. For example, the printer interface 718 may receive the information from the input interface 702, the book detector 706, the storage interface 716 and/or the data structure 116. The printer interface 718 may be configured to command the printing apparatus 420 to print the indicia or information on the printing area 608.

The printer adjustor 720 may be configured to position the distance 424 of the printer apparatus 420 relative to the printing area 608 of the first page 602. For example, the printer adjustor 720 may be configured to adjust the distance 424 based on the book characteristics from the input interface 702, the book detector 706, and/or a look-up table stored of the storage interface 716 and/or the data base 116. The printer adjustor 720 may be configured to cause the print adjustment mechanism 428 to move the printing apparatus 420 in the direction 424*a*. The printer adjustor 720 may adjust the distance 424 for each book identified by the book detector 706.

Figure 10:
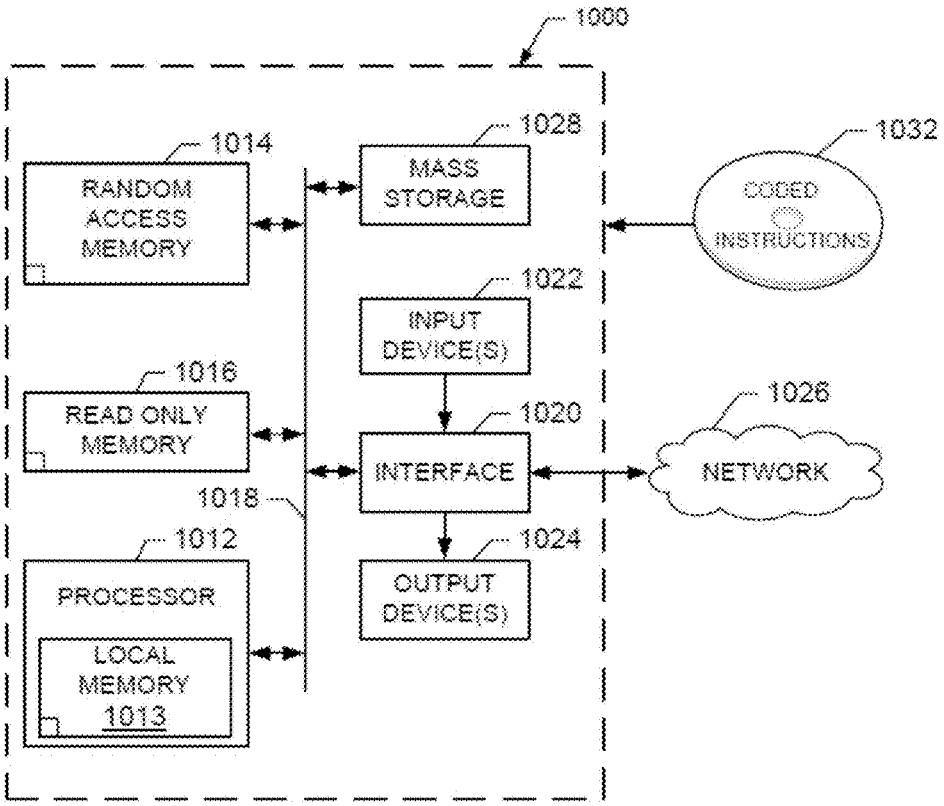
FIG. 10 is a block diagram of an example processor platform that may be used to implement the example methods and apparatus described herein.

The storage interface 716 may be configured to store data values in a memory such as, for example, the system memory 1013 and/or the mass storage memory 1028 of FIG. 10. Additionally, the storage interface 716 may be configured to retrieve data values from the memory (e.g., book characteristic(s) and/or indicia information). For example, the storage interface 716 may access a data structure to obtain book characteristics (e.g., book thickness) values from the memory and communicate the values to the suction generator 712 and/or the printer adjustor 720. The storage interface 716 may be configured to store the book characteristics or indicia information provided by the user interface 702, the book detector 706, the speed sensor interface 708, the pressure sensor interface 714 and/or the printer interface 718.

Figure 8:
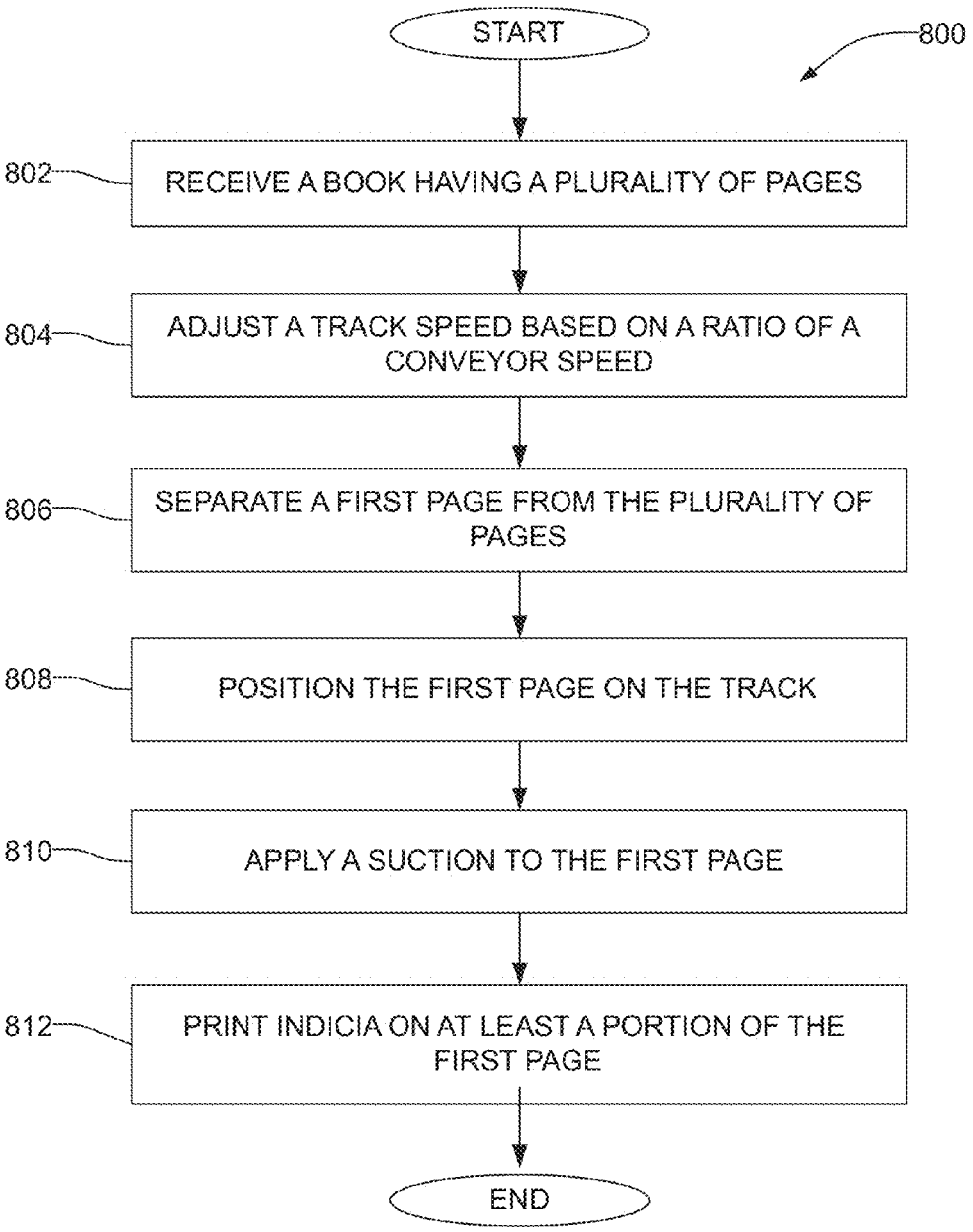
FIG. 8 is a flow chart diagram of an example method that may be used to control the example imaging apparatus of FIGS. 2, 3, 4A, 4B, 5A, 5B and 6.

FIG. 8 is a flow chart diagram of an example method that may be used to control the example imaging apparatus 200 of FIGS. 2, 3, 4A, 4B, 5A, 5B and 6. In some example implementations, the example method of FIG. 8 may be implemented using machine readable instructions comprising a program for execution by a processor platform (e.g., the processor platform 1012 of FIG. 7) such as, for example, a processor of the controller 204 (FIG. 2A). The program may be embodied in software stored on a tangible medium such as a CD-ROM, a floppy disk, a hard drive, a digital versatile disk (DVD), or memory associated with the processor 1012 and/or embodied in firmware and/or dedicated hardware in a well-known manner. Further, although the example program is described with reference to the flow chart illustrated in FIG. 8, persons of ordinary skill in the art will readily appreciate that many other methods of implementing the example imaging apparatus 200 may alternatively be used. For example, the order of execution of the blocks may be changed, and/or some of the blocks described may be changed, eliminated, or combined.

Turning in detail to FIG. 8, the imaging apparatus 200 receives a book 107 having a plurality of pages 602, 604 (block 802). For example, a conveyor 104 positions or directs the book to the imaging apparatus 200.

As the book travels toward the imaging apparatus 200, a track 304 of the imaging apparatus 200 is driven at a speed based on a ratio of the speed of the conveyor 104 (block 804). For example, the speed of the conveyor 104 is provided to the speed sensor interface 708 of the imaging apparatus 200 via a sensor and/or the controller 110. For example, the speed adjustor 710 adjusts the speed of the track 304 to a speed that is greater than the speed of the conveyor 104 by a predetermined percentage value (e.g., track speed=the conveyor speed+(5%*conveyor speed)).

A first page 602 of the book 107 is then separated from the plurality of pages (block 806). For example, the first page 602 is separated by the ramp 312 of the separator 310. The conveyor 104 continues to drive the book 107 toward the track 304 until the first page 602 of the book is positioned on the track 304 (block 808). With the first page 602 positioned on the track 304, a suction is applied to the first page 602 (block 810). For example, the suction generator 712 initiates the pump 322 to provide the suction. With the suction applied to the first page 602, indicia is printed on at least a portion (e.g., the printing area 608) of the first page 602 as the first page 602 moves at the track speed (block 812). The conveyor 104 then moves the book 107 away from the imaging apparatus 200.

Figure 9:
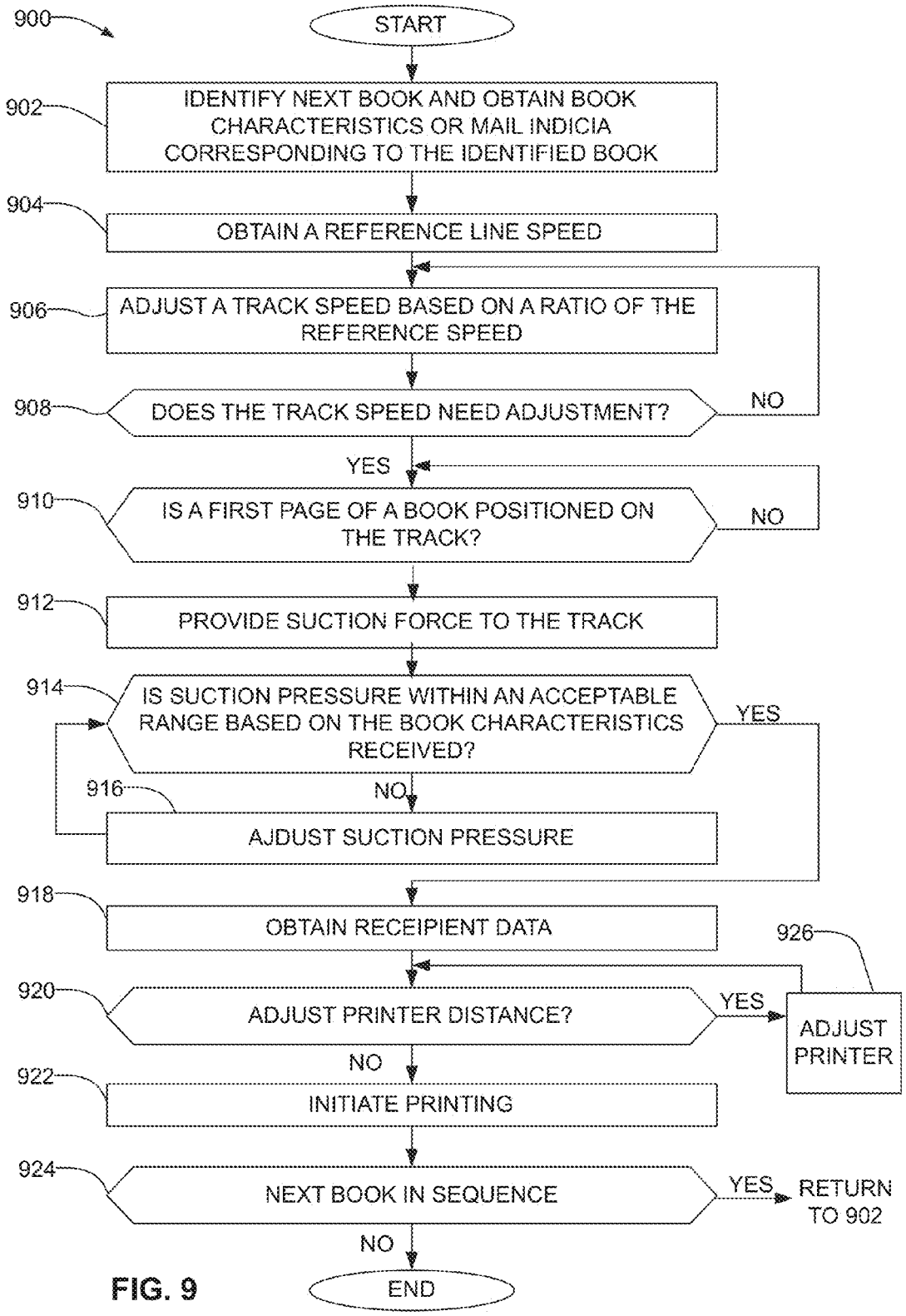
FIG. 9 is a flowchart representative of example machine readable instructions for implementing the apparatus of FIG. 7 and/or the example imaging apparatus of FIGS. 2, 3, 4A, 4B, 5A, 5B and 6.

A flowchart representative of example machine readable instructions for implementing the example imaging apparatus 200, the example system 700 of FIG. 7 and/or the example method 800 of FIG. 8 is shown in FIG. 9. In this example, the machine readable instructions comprise a program for execution by a processor such as the processor 1012 shown in the example processor platform 1000 discussed below in connection with FIG. 10. The program may be embodied in software stored on a tangible computer readable storage medium such as a CD-ROM, a floppy disk, a hard drive, a digital versatile disk (DVD), a Blu-ray disk, or a memory associated with the processor 1012, but the entire program and/or parts thereof could alternatively be executed by a device other than the processor 1012 and/or embodied in firmware or dedicated hardware. Further, although the example program is described with reference to the flowchart illustrated in FIG. 4, many other methods of implementing the example imaging apparatus 200, the example system 700 of FIG. 7 and/or the example method 800 of FIG. 8 may alternatively be used. For example, the order of execution of the blocks may be changed, and/or some of the blocks described may be changed, eliminated, or combined.

As mentioned above, the example processes of FIG. 9 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example processes of FIG. 9 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disk and to exclude propagating signals. As used herein, when the phrase "at least" is used as the transition term in a preamble of a claim, it is open-ended in the same manner as the term "comprising" is open ended.

The program of FIG. 9 at block 902 identifies a next book and obtains book characteristics and/or address indicia corresponding to the identified book (block 902). For example, the book detector 706 identifies the presence of the next book and correlates sequence of the next book to a sequential list stored, for example, in the data base 116, the input interface 702 and/or the storage interface 712.

A reference line speed is then obtained (block 904). For example, the reference line speed is the speed value representative of the speed of the conveyor 104 received by the speed sensor interface 708.

The speed of the track 304 is then adjusted based on a speed ratio of the reference speed obtained at block 904 (block 906). For example, the speed adjustor 710 adjusts the speed of the motor 406 and/or the track 304 to a predetermined speed that is greater than the reference speed value (e.g., the speed of the conveyor 104).

The comparator 704 and/or the speed sensor interface 708 determine if the track speed needs adjustment (block 908). If, for example, the speed of the track 304 is greater than or less than the speed ratio of the reference speed, then the speed of the track needs adjustment. For example, the speed adjustor 710 adjusts the speed of the track 304 until the speed value detected by the speed sensor interface 708 and/or the comparator 704 is at a speed value substantially equal to (e.g., plus or minus an error value or buffer range) the speed ratio of the reference speed.

If the speed of the track 304 detected at block 908 does not need adjustment at block 908, the book detector 706 detects if a first page 602 of a book 107 is positioned on the track 304 (block 910). For example, the book detector 706 may receive a signal from the sensor 616 indicating that the first page 602 is positioned on the track 304 or is about to be positioned on the track 304. If first page 602 is not positioned on the track 304 at block 910, the program 900 to block 910. In some examples, after a certain period of time has lapsed without detecting the first page positioned on the track 304, the page detector 706 may be configured to initiate an alarm.

If the book detector 706 detects the presence of the first page 602 on the track 304, the suction pressure is provided to the track 304 (block 912). For example, the suction generator 712 may cause the pump 322 to provide the suction pressure to the track 304 via the platform 302.

The program at block 914 then determines if the suction pressure is within an acceptable range based on the book characteristics received at block 902 (block 914). For example, the pressure sensor interface 714 receives a pressure value from the regulator 328 indicative of the suction pressure provided to the track 304. The pressure sensor interface 714 and/or the suction generator 712 may compare the measured suction pressure value received from the pressure regulator 328 to a maximum allowable suction pressure based on the book characteristics obtained at block 902. For example, a maximum allowable suction pressure for a certain book characteristic may be provided in a look-up table and/or the storage interface 716.

If the suction pressure is not within an acceptable range at block 914, the suction pressure is adjusted (block 914). For example, the suction generator 712 and/or the pressure sensor interface 714 adjust the pump 322 until the suction pressure is within the acceptable range.

If the suction pressure is within an acceptable range at block 914, the printer interface 718 obtains the indicia information (block 918). For example, the printer interface 718 may obtain the indicia information from the data base 116, the storage interface 716, and/or the input interface 702.

The program at block 918 may also be configured to determine if the distance 424 of the printing apparatus 420 needs adjustment (block 920). For example, the printer interface 718 may determine if the distance 424 needs to be adjusted based on the book characteristics (e.g., a thickness value of the first page 602) received at block 902.

If adjustment is needed at block 920, the printer adjustor 720 adjusts the distance 424 of the printer apparatus 428 (block 926). For example, the printer adjustor 720 may cause the printer adjustment mechanism 428 to move toward or away from the first page 602 in the direction 424*b* until no further adjustment is needed.

If the distance 424 does not need to be adjusted at block 920, then printer interface 718 initiated printing (block 922). For example, the printer interface 718 commands the printer apparatus 420 to print the indicial information (e.g., the recipient's information or bar code) on the printing area 608 of the first page 602.

After printing at block 920, the book detector 706 detects if there is a next book in the sequence (block 922). If a next book is detected in the sequence at block 922, then the program returns to block 902. If a next book is not detected in the sequence at block 922, then the program ends.

FIG. 10 is a block diagram of an example processor platform 1000 capable of executing the instructions of FIGS. 8 and 9 to implement the apparatus of FIGS. 2, 3, 4A, 4B, 5A, 5B, 6 and 7. The processor platform 1000 can be, for example, a Programmable Logic Circuit (PLC), a server, a personal computer, a mobile device (e.g., a tablet such as an iPad™), or any other type of computing device.

The processor platform 1000 of the illustrated example includes a processor 1012. The processor 1012 of the illustrated example is hardware. For example, the processor 1012 can be implemented by one or more integrated circuits, logic circuits, microprocessors or controllers from any desired family or manufacturer.

The processor 1012 of the illustrated example includes a local memory 1013 (e.g., a cache). The processor 1012 of the illustrated example is in communication with a main memory including a volatile memory 1014 and a non-volatile memory 1016 via a bus 1018. The volatile memory 1014 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1016 may be implemented by flash memory and/or any other desired type of memory device. Access to the main memory 1014, 1016 is controlled by a memory controller.

The processor platform 1000 of the illustrated example also includes an interface circuit 1020. The interface circuit 1020 may be implemented by any type of interface standard, such as an Ethernet interface, a universal serial bus (USB), and/or a PCI express interface.

In the illustrated example, one or more input devices 1022 are connected to the interface circuit 1020. The input device (s) 1022 permit(s) a user to enter data and commands into the processor 1012. The input device(s) can be implemented by, for example, an audio sensor, a microphone, a keyboard, a button, a mouse, a touchscreen, a track-pad, and/or a voice recognition system.

One or more output devices 1024 are also connected to the interface circuit 1020 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1020 of the illustrated example, thus, typically includes a graphics driver card, a graphics driver chip or a graphics driver processor.

The interface circuit 1020 of the illustrated example also includes a communication device such as a transmitter, a receiver, a transceiver, a modem and/or network interface card to facilitate exchange of data with external machines (e.g., computing devices of any kind) via a network 1026 (e.g., an Ethernet connection, a digital subscriber line (DSL), a telephone line, coaxial cable, a cellular telephone system, etc.).

The processor platform 1000 of the illustrated example also includes one or more mass storage devices 1028 for storing software and/or data. Examples of such mass storage devices 1028 include floppy disk drives, hard drive disks, compact disk drives, Blu-ray disk drives, RAID systems, and digital versatile disk (DVD) drives.

The coded instructions 900 of FIG. 9 may be stored in the mass storage device 1028, in the volatile memory 1014, in the non-volatile memory 1016, and/or on a removable tangible computer readable storage medium such as a CD or DVD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed:

1. An apparatus comprising:

a platform having a plurality of openings to provide a suction through a surface of the platform;

a first track to move across the surface of the platform, the first track having a plurality of apertures to fluidly couple the suction to an upper surface of the first track; and a separator to receive a signature assembly, the separator comprising:

an end to engage the signature assembly to separate a first page from the signature assembly;

a tapered surface to guide the first page toward the first track; and a side extending from the tapered surface to guide a second page of the signature assembly toward a side of the platform.

2. The apparatus of claim 1, wherein the suction is to draw the first page toward the upper surface of the first track when the first page is positioned on the first track and travels across the surface of the platform via the first track.

3. The apparatus of claim 2, further comprising a pressure regulator to regulate a pressure of the suction applied to the first page.

4. The apparatus of claim 1, further comprising a second track to advance a signature assembly to the apparatus.

5. The apparatus of claim 1, wherein the suction is provided via a pump.

6. The apparatus of claim 1, further comprising a motor to drive the first track across the surface of the platform.

7. The apparatus of claim 1, wherein the first track comprises a belt.

8. The apparatus of claim 1, wherein the platform includes a groove to receive the first track.

9. The apparatus of claim 1, further comprising an imager to provide an image to at least a portion of a first page when the first page is positioned on the first track and the suction is applied to the first page.

10. A method comprising:

moving a first track across a surface of a platform;

applying a suction to the surface of the platform; and separating a first page of a book from a plurality of pages of the book to cause the first page to move across the surface via the first track and the plurality of pages to move alongside the first track, the first track having apertures to fluidly couple the suction to the first page to hold the first page against an upper surface of the first track when the first page is positioned on the first track.

11. The method of claim 10, further comprising receiving the signature assembly from a second track.

12. The method of claim 10, further comprising printing indicia on the first page as the first page moves across the platform via the first track and the suction is applied to the surface of the platform.

13. The method of claim 10, further comprising regulating a pressure of the suction.

14. The method of claim 10, further comprising providing fluid openings through the surface of the platform to fluidly couple the suction to the first page.

15. A method, comprising:

moving a first track across a surface of a platform;

applying a suction to the surface of the platform;

receiving a signature assembly from a second track separating a first page from a plurality of pages of the signature assembly to cause the first page to move across the surface via the first track, the first track having apertures to fluidly couple the suction to the first page to hold the first page against an upper surface of the first track when the first page is positioned on the first track; and driving the first track at a first speed and driving the second track at a second speed, the first speed being based on a ratio value of the second speed.

16. A method, comprising:

moving a first track across a surface of a platform;

applying a suction to the surface of the platform;

separating a first page from a plurality of pages of a signature assembly to cause the first page to move across the surface via the first track, the first track having apertures to fluidly couple the suction to the first page to hold the first page against an upper surface of the first track when the first page is positioned on the first track; and guiding a second page of the plurality of pages adjacent a side surface of the first track.

17. An apparatus comprising:

means for moving a first page of a book across a surface of a platform;

means for providing a suction to the surface of the platform;

means for fluidly coupling the suction to the surface of the platform;

means for fluidly coupling the means for providing the suction to the surface of the platform to the first page to hold the first page against the means for moving when the first page is positioned on the means for moving; and means for separating the first page from a plurality of pages such that only the first page is positioned on the means for moving and the plurality of pages are positioned on a side of the means for moving.

18. The apparatus of claim 17, means for printing an image on the first page when the suction is applied to the first page and the first page is positioned on the means for moving.

19. The apparatus of claim 17, further comprising means for regulating a pressure provided by the means for providing the suction.

20. An apparatus comprising:

a platform to provide a suction through a surface of the platform;

a first track to move across the surface of the platform, the first track having a plurality of apertures to fluidly couple the suction to an upper surface of the first track;

a separator to receive a signature assembly, the separator to separate a first page from the signature assembly and guide the first page toward the first track, the suction to hold the first page against the upper surface of the first track when the first page is positioned on the first track;

a second track to receive the signature assembly;

a first drive to drive the first track at a first speed; and a second drive to drive the second track at a second speed, the first speed being based on a ratio value of the second speed.

* * * * *